United States Patent [19]

Satou et al.

[11] 4,450,019

[45] May 22, 1984

[54] DUCTILE CAST IRON

[75] Inventors: Kazuo Satou, Higashihiroshima; Masashi Yoritaka, Hiroshima, both of Japan

[73] Assignee: Toyo Kogyo Co., Ltd., Hiroshima, Japan

[21] Appl. No.: 480,572

[22] Filed: Mar. 30, 1983

[30] Foreign Application Priority Data

Apr. 1, 1982 [JP] Japan ..... 57-55053

[51] Int. Cl.[3] ..... C22C 37/10

[52] U.S. Cl. ..... 148/35; 75/123 CB; 75/123 E; 75/123 J; 75/123 L

[58] Field of Search ..... 75/123 CB, 123 E, 123 J, 75/123 L; 148/35; 60/323

[56] References Cited

U.S. PATENT DOCUMENTS

| | | | |
|---|---|---|---|
| 2,622,022 | 12/1952 | Crome | 75/123 CB |
| 2,809,888 | 10/1957 | Schelleng et al. | 148/35 |
| 2,970,902 | 2/1961 | Alexander et al. | 75/123 CB |
| 3,565,698 | 2/1971 | de Beaulieu | 148/35 |
| 4,372,112 | 2/1983 | Ackerman et al. | 60/323 |

*Primary Examiner*—L. Dewayne Rutledge
*Assistant Examiner*—Debbie Yee
*Attorney, Agent, or Firm*—Burns, Doane, Swecker & Mathis

[57] ABSTRACT

A ductile cast iron excellent in resistance to both oxidation at high temperatures and thermal fatigue, comprising C: 2.5 to 3.8 wt %, Si: 3.5 to 4.8 wt %, Mn: up to 1.0 wt %, P: up to 0.1 wt %, S: up to 0.1 wt %, Mo: 0.5 to 2.0 wt %, Mg: 0.03 to 0.1 wt %, at least one of Ce and La: 0.02 to 0.5 wt %, and Fe.

3 Claims, 1 Drawing Figure

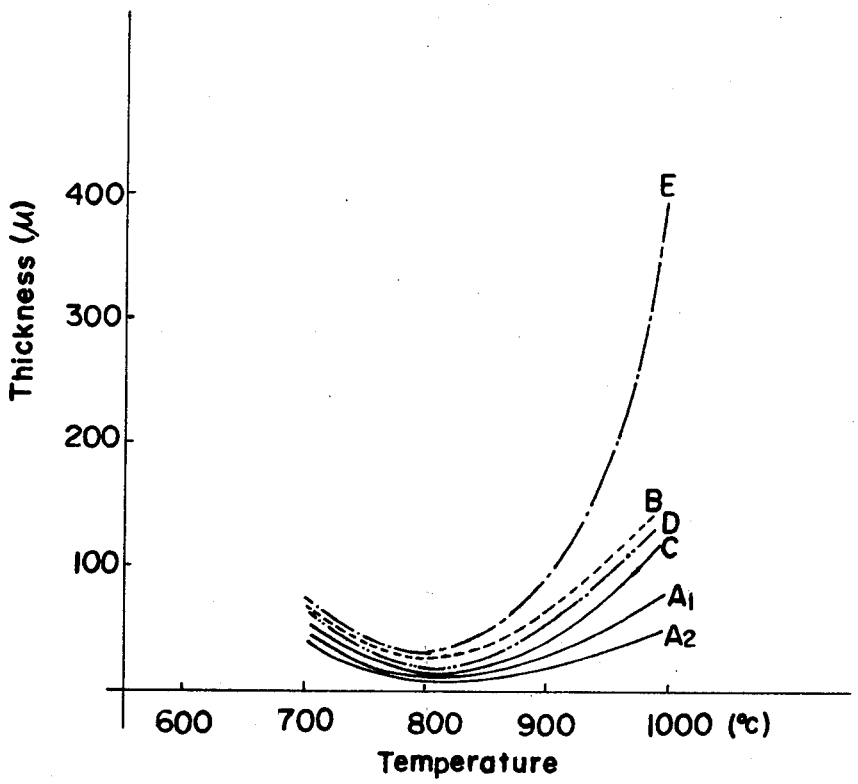
Thickness (μ)
400
300
200
100
E
B
D
C
A1
A2
600
700
800
900
1000 (°c)
Temperature

DUCTILE CAST IRON

BACKGROUND OF THE INVENTION

This invention generally relates to a ductile cast iron or spherulitic graphite cast iron and, more particularly, to the ductile cast iron having an improved resistance to oxidation at high temperatures and an improved resistance to thermal fatigue. The ductile cast iron, which is also referred to as spherulitic graphite cast iron, according to this invention exhibits a high resistance to both oxidation at high temperatures and thermal fatigue when used as a material for an automobile exhaust manifold.

As is well known, an automobile exhaust manifold, i.e., the piping through which high temperature exhaust gases discharged from an automobile combustion engine flow, tends to be alternately heated and cooled, receiving a frequent thermal shock. Therefore, the automobile exhaust manifold is generally required to have a relatively high resistance to oxidation at high temperatures and also a relatively high resistance to thermal fatigue. In particular, the resistance to oxidation is an important property for the suppression of the growth of an oxide layer and the improvement on the peel resistance of the oxide layer. The failure to have a capability of suppressing the oxide layer and a high peel resistance tends to result in separation of oxide scales which would, when the exhaust system of the automobile engine is held under negative pressure such as occurring during the transit period in which the fuel intake and exhaust valves are simultaneously opened, be sucked towards the engine cylinder. Once this happens, the oxide scales so sucked will constitute a cause of accelerated wear of the valve member, the valve seat and the internal surface of the engine cylinder.

In view of the above, a high resistance to oxidation at high temperatures is an essential property which a material for the exhaust manifold must have.

Hitherto, as a metallic material excellent in resistance to oxidation at high temperatures, there has been well known a ductile cast iron which exhibits a ferrite structure as cast and contains carbon in an amount of 3.3 to 4.0 wt%, silicon in an amount of 3.5 to 4.5 wt%, phosphorous in an amount of 0.04 wt% or less, manganese in an amount of 0.3 wt% or less, sulfur in an amount of 0.01 wt% or less, and magnesium in an amount of 0.02 to 0.04 wt%. The ductile cast of the above described composition is disclosed in, for example, the Japanese Patent Publication No. 54-38968 published Nov. 24, 1979, and is described as suitable for the production of automobile exhaust manifolds.

In this prior art ductile cast iron, since silicon is contained in an amount within the range of 3.5 to 4.5 wt%, which silicon forms a protective layer of $SiO_2$, the amount of oxide scales formed is minimized, and since the content of any one of phosphorous, manganese and sulfur is relatively small, the cracking would not tend to occur readily although it can not be avoided to such an extent as to make the cast iron utilizeable in practical production.

Despite the advantage in that, since the content of silicon is relatively great, the amount of oxide scales formed can be minimized, the employment of a relatively great amount of silicon such as within the range of 3.5 to 4.5 wt% renders the matrix so fragile that the thermal fatigue characteristic thereof is considerably lowered.

SUMMARY OF THE INVENTION

Accordingly, this invention has been developed with a view to substantially eliminating the above described disadvantages inherent in the prior art ductile cast iron and has for its essential object to provide an improved ductile cast iron excellent in both resistance to oxidation at high temperatures and resistance to thermal fatigue.

Another important object of this invention is to provide an improved ductile cast iron of the kind referred to above, which can readily be manufactured without substantially altering the existing casting facilities and merely by adding two elements to the composition of the prior art ductile cast iron.

In order to accomplish these objects, this invention provides an improved ductile cast iron of a composition including carbon (C) in an amount of 2.5 to 3.8 wt%, silicon (Si) in an amount of 3.5 to 4.8 wt%, manganese (Mn) in an amount of 1.0 wt% or less, phosphorous (P) in an amount of 0.1 wt% or less, sulfur (S) in an amount of 0.1 wt% or less, molybdenum (Mo) in an amount of 0.5 to 2.0 wt%, magnesium (Mg) in an amount of 0.03 to 0.1 wt%, at least one of cerium (Ce) and lanthanum (La) in an amount of 0.02 to 0.5 wt% and ferrum (Fe) in the balance.

The ductile cast iron of the above described composition according to this invention is such as to have a matrix of ferrite structure in a quantity equal to or higher than 90 by area %.

In practising this invention, if the content of C is smaller than the lower limit of 2.5 wt%, the fluidity of the molten metal tends to be adversely affected because of the degree of saturation of Si, with the consequent formation of unwanted shrinkage cavities in the final product, and if it is greater than the upper limit of 3.8 wt%, dross-like flaws in which graphite coagulates and will not spherodize are likely to result in because of its relationship with Si, with consequent reduction in physical strength.

With respect to the content of Si, if it is smaller than the lower limit of 3.5 wt%, not only can the requisite protective layer of $SiO_2$ not be formed with the final product consequently failing to exhibit the resistance to oxidation at high temperatures, but also casting defects such as shrinkage cavities tend to result in because of the degree of saturation of C. On the other hand, if it is greater than the upper limit of 4.8 wt%, the graphite tends to precipitate readily to such an extent as to result in the formation of casting defects such as the coagulation of graphite and, at the same time, as to result in the degradation of the thermal fatigue characteristic, it being however, to be noted that the use of a relatively great amount of Mo will result in the recovery of the thermal fatigue characteristic.

The reason for the limitation of the content of Mn to a value not greater than 1.0 wt% is because Mn, although it is an element tending to inhibit the oxidation resistance, is inevitably included in the molten raw material and, therefore, a satisfactory casting operatively can be ensured when it is not greater than 1.0 wt%.

Similarly, the reason for the limitation of the content of P to a value not greater than 0.1 wt% is because P is inevitably included in the molten raw material and, therefore, a satisfactory casting operatively can be ensured when it is not greater than 0.10 wt%.

The reason for the limitation of the content of S to a value not greater than 0.1 wt% is as follows. Namely, since S is an element tending to inhibit the spheroidization of graphite, desulfurization is carried out by the addition of Mg, it being, however, to be noted that the use of Mg in a relatively great amount tends to constitute a cause for the formation of intervening substances which tends to bring about a secondary damage such as, for example, reduction in physical strength. Accordingly, if the content of S is fixed to be not greater than 0.1 wt% in consideration of the desulfurization accomplished by the presence of Mg and the secondary damage brought by the employment of Mg in a relatively great amount, the final product can be acceptable as a material for articles of manufacture.

With respect to the content of Mo, if it is smaller than 0.5 wt%, the thermal fatigue characteristic of the matrix which is reduced because of the presence of a relatively great amount of Si cannot be recovered, and if it is greater than the upper limit of 2.0 wt%, the effect on the thermal fatigue will be saturated and the cost will increase.

With respect to the content of Mg, if it is smaller than the lower limit of 0.03 wt%, no satisfactory spheroidization can be accomplished, and if it is greater than the upper limit of 0.1 wt%, a dross-like defect will be formed with oxides of Mg and sulfides coagulating in the molten pool.

The content of any one of Ce and La is limited within the range of 0.02 to 0.5 wt% because if it is smaller than the lower limit of 0.02 wt%, Si will not disperse exteriorly, that is, towards the surface region of the final casting with no oxide layer of $SiO_2$ being formed satisfactorily and also with the oxide layer failing to have a strong bondability, and the property of Mo inhibiting the resistance to oxidation can not be neutralized satisfactorily and because if it is greater than the upper limit of 0.5%, a compound of low melting point will be formed and cracking will occur during the use.

With respect to the matrix of the cast iron, if the ferrite structure is smaller than 90 by area %, it causes that parlite structure increases in the form as cast so that the machining property is decreased and the deformation of the cast iron causes by changing in quality of the parlite structure when the cast iron is received the thermal shock.

Furthermore, according to this invention, where the ductile cast iron is used as a material for the automobile exhaust manifold, the ductile cast iron of a composition containing C: 3.1 to 3.3 wt%, Si: 4.3 to 4.6 wt%, Mn: 0.2 to 0.5%, S: 0.005 to 0.015 wt%, P: 0.01 to 0.03 wt%, Mo: 0.7 to 0.9 wt%, Ce: 0.02 to 0.04 wt%, Mg: 0.035 to 0.045 wt% and Fe being the remainder is considered convenient for production and is, therefore, preferred.

BRIEF DESCRIPTION OF THE DRAWING

These and other objects and features of this invention will become clear from the following description of illustrative examples made with reference to the accompanying drawing which shows the relationship between the thickness of an oxide layer and the temperature.

DETAILED DESCRIPTION OF THE EMBODIMENT

Examples of this invention and the test results thereof are tabulated in the following table. These examples are only for the purpose of illustration of this invention and are not intended to limit the scope thereof. For comparison purpose, examples of prior art compositions and the test results thereof are also tabulated in the same table.

It will readily be seen that the ductile cast iron of the composition E has an extremely inferior resistance to oxidation at high temperature as shown by a curve E in the drawing because the content of Si is as small as 2.85 wt% and that, under the condition of 1000° C. in ambient temperature for 10 hours, the scale thickness and the amount of scale-out are respectively not smaller than 400 microns and 21.5 mg/cm$^2$, and therefore, the oxide layer cannot be controlled and the peel resistance thereof is very low.

On the contrary thereto, it will readily be seen that the ductile cast iron of the composition D wherein the content of Si is increased to 4.58 wt% exhibits an increased resistance to oxidation at high temperatures as shown by a curve D in the drawing and that, under the condition of 1000° C. in ambient temperature for 10 hours, the thickness of the oxide layer and the amount of scale-out are 135 microns and 7.0 mg/cm$^2$, respectively, and therefore, the oxide layer can be controlled and the peel resistance thereof can be improved. However, since the ductile cast iron of the composition D contains the increased amount of Si, the number of thermal cycles which it can withstand when cyclically heated to 900° C. and cooled to 200° C. is 60 cycles (in contrast to 150 or more cycles exhibited by the ductile cast iron of the composition E) and, therefore, the thermal fatigue strength is extremely reduced.

In contrast to the composition D, in the ductile cast iron of the composition B wherein Mo is added in an amount of 1.13 wt% as shown in the table, the thermal fatigue strength is recovered to 150 cycles or more, as is the case with the composition E, by the action of Mo. However, as shown by a curve B in the drawing and also shown in the table, the ductile cast iron of the composition B exhibits the thickness of the scale and the amount of scale-out under the condition of 1000° C. in ambient temperature for 10 hours are 150 microns and 7.1 mg/cm$^2$, respectively, and, thus, a reduced resistance to oxidation at high temperatures as compared with that of the composition D.

On the other hands, the ductile cast irons of the respective compositions $A_1$ and $A_2$ which are modified versions of the composition B to which Ce is added in an amount of 0.03 wt% and 0.025 wt%, respectively, exhibit an extremely improved resistance to oxidation at high temperatures and superior to that exhibited by the composition D. Thus, when a predetermined amount of Ce is added, the resistance to oxidation at high temperatures is increased with the reduction of the resistance to oxidation at high temperatures attributable to the addition of Mo having been compensated for. As shown in the table, under the condition of 1000° C. in ambient temperature for 10 hours, the scale thickness and the amount of scale-out exhibited by the ductile cast iron of the composition $A_1$ and those of the composition $A_2$ are 78 microns and 0.6 mg/cm$^2$, and 56 microns and 1.2 mg/cm$^2$, respectively. It will, therefore, readily be seen that the ductile casst irons of the respective compositions $A_1$ and $A_2$ are effective to suppress the thickness of the oxide layer considerably and are extremely excellent in the peel resistance of the oxide layer. In addition, as is the case with the composition B, each of the ductile cast irons of the respective compositions $A_1$ and $A_2$ can withstand more than 150 cycles of cyclic heating to 900° C. and cooling to 200° C. and, therefore, maintains a high resistance to thermal fatigue.

From the foregoing, each of the ductile cast irons of the respective compositions $A_1$ and $A_2$ is excellent in resistance to oxidation at high temperatures and also in resistance to thermal fatigue and is extremely advantageous when used as a material for the automobile exhaust manifolds.

It is to be noted that the ductile cast iron of the composition $A_1$ is comprised of 13 by area % graphite and 87 by area % matrix. Of the matrix, 92 by area % is a ferrite structure and 8 by area % is a perlite structure.

It is also to be noted that, referring to the table and the drawing, the ductile cast iron of the composition C contains Ce in an amount of 0.03 wt% with no addition of Mo. Although the resistance to oxidation at high temperature, exhibited by the ductile cast iron of the composition is improved extremely by the action of Ce as compared with that of the composition E, but exhibits the reduced resistance to thermal fatigue because no Mo is added.

From the foregoing, its has now become clear that, since the ductile cast iron of this invention contains C: 2.5 to 3.8 wt%, Si: 3.5 to 4.8 wt%, Mn: up to 1.0 wt%, P: up to 0.1 wt%, S: up to 0.1 wt%, Mo: 0.5 to 2.0 wt%, Mg: 0.03 to 0.1 wt%, at least one of Ce and La: 0.02 to 0.5 wt% and Fe being the balance and has 90 by area % or more ferrite structure when in the form as cast, it has such an advantage in that it is excellent in resistance to oxidation at high temperatures and also in resistance to thermal fatigue.

Although this invention has fully been described by way of the example, it is to be noted that various changes and modifications are apparent to those skilled in the art. Such changes and modifications are to be understood as included within the true scope of this invention unless they depart therefrom.

| Samples | Composition (wt %) C | Si | Mn | S | P | Mo | (La) Ce | Mg | Thermal Fatigue 200⇄900° C. No. of Cycles | Amount of Scale-out 1000° C. × 10 hr (mg/cm²) | Scale Thickness 1000° C. × 10 hr (micron) |
|---|---|---|---|---|---|---|---|---|---|---|---|
| | | | | | | | INVENTION | | | | |
| A1 | 3.39 | 4.48 | 0.35 | 0.009 | 0.020 | 1.10 | 0.03 | 0.046 | 150 or more | 0.6 | 78 |
| A2 | 3.53 | 4.78 | 0.48 | 0.017 | 0.024 | 0.80 | 0.025 | 0.039 | " | 1.2 | 56 |
| | | | | | | | COMPARISON | | | | |
| B | 3.43 | 4.46 | 0.36 | 0.009 | 0.021 | 1.13 | | 0.044 | " | 7.1 | 150 |
| C | 3.44 | 4.40 | 0.24 | 0.007 | 0.023 | | 0.03 | 0.046 | 50 | 6.5 | 123 |
| D | 3.45 | 4.58 | 0.33 | 0.006 | 0.021 | | | 0.042 | 60 | 7.0 | 135 |
| E | 3.46 | 2.85 | 0.25 | 0.009 | 0.020 | | 0.013 | 0.043 | 150 or more | 21.5 | 400 or more |

We claim:

1. A ductile cast iron excellent in resistance to both oxidation at high temperatures and thermal fatigue, which consists essentially of carbon in an amount of 2.5 to 3.8 wt%, silicon in an amount of 3.5 to 4.8 wt%, manganese in an amount of 1.0 wt% or less, phosphorus in an amount of 0.1 wt% or less, sulfur in an amount of 0.1 wt% or less, molybdenum in an amount of 0.5 to 2.0 wt%, magnesium in an amount of 0.03 to 0.1 wt%, at least one of cerium and lanthanum in an amount of 0.02 to 0.5 wt% and iron in the balance.

2. A ductile cast iron as claimed in claim 1, in which the matrix of the said ductile cast iron has 90 by area % or more ferrite structure in the form as cast.

3. An automobile exhaust manifold comprised of the ductile cast iron as defined in claim 1.

* * * * *